US012680263B2

(12) United States Patent
Peeters

(10) Patent No.: US 12,680,263 B2
(45) Date of Patent: Jul. 14, 2026

(54) MINILOADER

(71) Applicant: PEETERS LANDBOUWMACHINES B.V., Etten-Leur (NL)

(72) Inventor: Daniel Petrus Marie Peeters, Etten-Leur (NL)

(73) Assignee: Peeters Landbouwmachines B.V., Etten-leur (NL)

( * ) Notice: Subject to any disclaimer, the term of this patent is extended or adjusted under 35 U.S.C. 154(b) by 225 days.

(21) Appl. No.: 18/701,891

(22) PCT Filed: Oct. 25, 2022

(86) PCT No.: PCT/NL2022/050603

§ 371 (c)(1),
(2) Date: Apr. 16, 2024

(87) PCT Pub. No.: WO2023/080776

PCT Pub. Date: May 11, 2023

(65) Prior Publication Data

US 2024/0410127 A1 Dec. 12, 2024

(30) Foreign Application Priority Data

Nov. 8, 2021 (NL) ..... 2029665

(51) Int. Cl.
*E02F 3/28* (2006.01)
*E02F 3/36* (2006.01)
(Continued)

(52) U.S. Cl.
CPC ..... *E02F 3/286* (2013.01); *E02F 3/3681* (2013.01); *E02F 3/431* (2013.01); *E02F 9/0841* (2013.01);
(Continued)

(58) Field of Classification Search
CPC ..... E02F 3/286; E02F 3/3677; E02F 3/3681; E02F 3/431
See application file for complete search history.

(56) References Cited

U.S. PATENT DOCUMENTS 2,852,149 A * 9/1958 Bruneri ..... E02F 9/121 212/247
3,224,608 A * 12/1965 Yadon ..... E02F 3/286 414/718
2018/0171578 A1* 6/2018 Smekal ..... E02F 3/433

FOREIGN PATENT DOCUMENTS

CN 107059964 A 8/2017
DE 1114738 B * 10/1961
(Continued)

OTHER PUBLICATIONS

International Search Report issued in PCT/NL2022/050603 on Jan. 27, 2023.

*Primary Examiner* — Michael McCullough
*Assistant Examiner* — Jessica Burkman
(74) *Attorney, Agent, or Firm* — NIXON PEABODY LLP

(57) ABSTRACT

A miniloader includes an articulated chassis, with a boom pivot device arranged on a front chassis part, a pivotable boom thereon including an upwardly extending first arm part which is fixedly arranged on the boom pivot device for pivoting of the boom relative to the chassis about a vertical boom pivot axis line during operation of the miniloader, a second arm part which with a first end is arranged on a free end of the first arm part and is pivotable relative thereto about a first horizontal pivot axis line between retracted and extended states, a coupling piece arranged pivotably about a second horizontal pivot axis line on a second end of the second arm part for coupling a tool thereto. In the retracted state of the second arm part, the second horizontal pivot axis line lies within the circumference of the front wheels.

18 Claims, 5 Drawing Sheets

Figure 1:
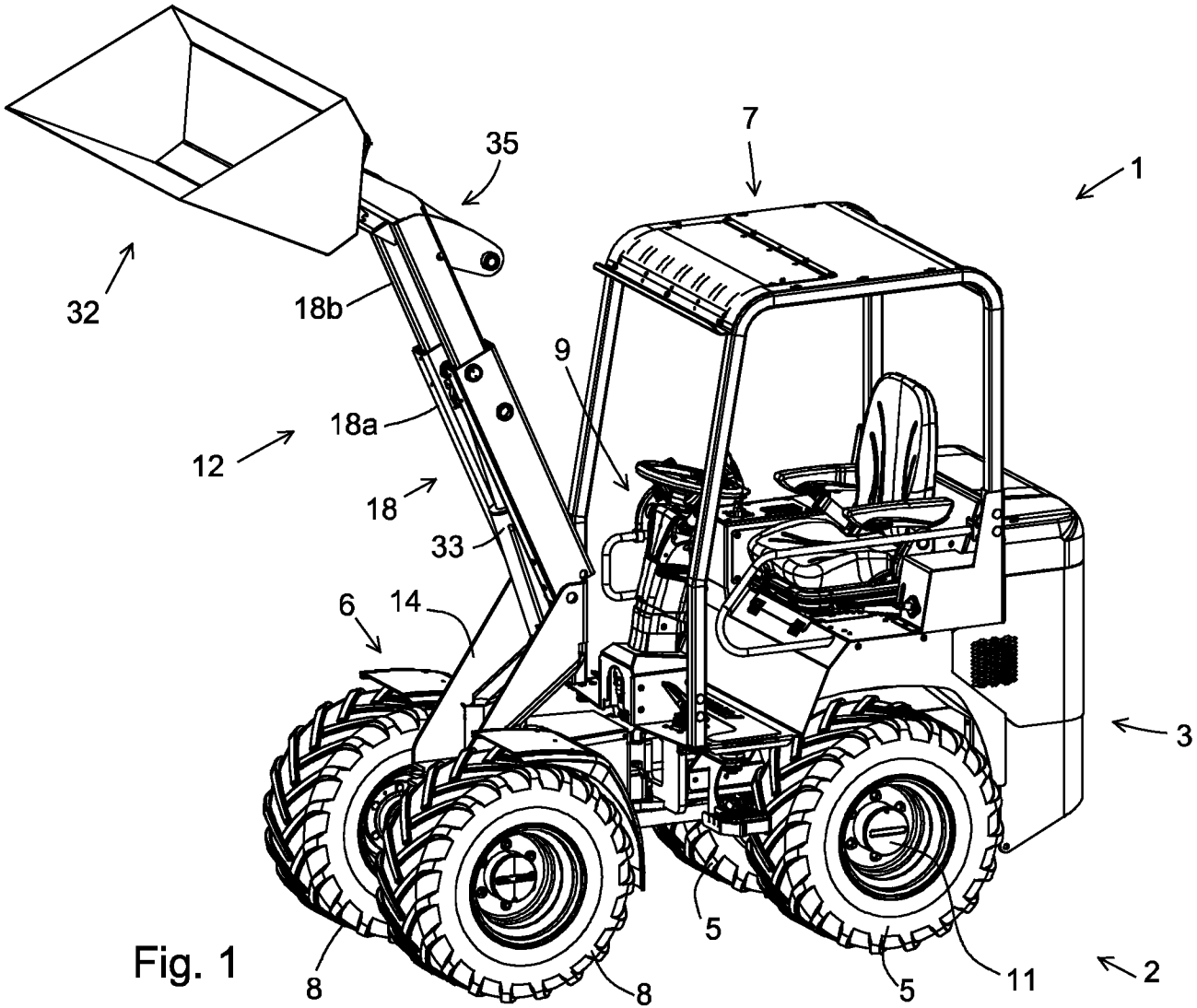

(51) Int. Cl.

| | |
|---|---|
| ***E02F 3/43*** | (2006.01) |
| ***E02F 9/08*** | (2006.01) |
| ***E02F 9/16*** | (2006.01) |
| ***E02F 9/24*** | (2006.01) |
| ***E02F 9/26*** | (2006.01) |

(52) U.S. Cl.
CPC ..... *E02F 9/16* (2013.01); *E02F 9/24* (2013.01); *E02F 9/264* (2013.01)

(56) References Cited

FOREIGN PATENT DOCUMENTS

| | | | |
|---|---|---|---|
| DE | 19636649 | A1 | 3/1998 |
| IT | BO20090189 | A1 | 9/2010 |

* cited by examiner

MINILOADER

CROSS-REFERENCE TO RELATED APPLICATIONS

The present application is a U.S. National Stage Entry of International Application No. PCT/NL2022/050603 filed on Oct. 25, 2022, which claims priority to and benefit of Netherlands Patent Application No. 2029665 filed on Nov. 8, 2021, each of which is hereby incorporated by reference in its entirety.

The present invention concerns a miniloader of the articulated type. Such miniloaders have an articulated chassis. A miniloader, also called a compact loader or mini-shovel, is a specific type of loader which is designed to work in a restricted area, for carrying out shovelling and lifting activities. The own weight of the miniloader to which the invention relates is less than 2500 kg, and the width is less than 1.30 m. A miniloader of the articulated type has a fixed front axle and a fixed rear axle, which means that neither the front wheels nor the rear wheels are steered. The miniloader is steered by pivoting or "bending" the front and rear chassis parts relative to one another.

An object of the invention is to provide an improved miniloader of the articulated type. It is an object of the invention to provide a miniloader of the articulated type which can be almost universally used. It is an object of the invention to provide a miniloader of the articulated type with a large working range with respect to the accessible working area and weight loading.

One or more of these objects is/are achieved with a miniloader according to the invention as defined in claim 1, comprising:

- an articulated chassis comprising
  - a rear chassis part on which rear wheels are provided,
  - a front chassis part which is pivotable relative to the rear chassis part about a vertical chassis pivot axis line, and on which front wheels are provided,
  - a steering device for steering the miniloader by means of pivoting of the front chassis part and rear chassis part relative to one another about the chassis pivot axis line, and
  - a boom pivot device arranged on the front chassis part, the miniloader furthermore comprising:
- a pivotable boom mounted on the boom pivot device, the boom comprising:
  - an upwardly extending first arm part which is fixedly arranged on the boom pivot device, for pivoting of the boom relative to the chassis about a vertical boom pivot axis line during operation of the miniloader,
  - a second arm part which with a first end is arranged on a free end of the first arm part and which is pivotable relative to the first arm part about a first horizontal pivot axis line between a retracted state, in which the second arm part extends downward, and an extended state in which the second arm part extends upward, and
  - a coupling piece which is arranged on a second end of the second arm part located opposite the first end and is pivotable about a second horizontal pivot axis line, for coupling thereto a tool such as a loading bucket,
- wherein in the retracted state of the second arm part, the second horizontal pivot axis line lies within the circumference of the front wheels, viewed in a side view of the miniloader.

An effect of the miniloader according to the invention is that, by providing the pivotable boom, wherein the second horizontal pivot axis line (being the pivot axis line about which the coupling piece pivots relative to the second arm part of the boom, for coupling thereto a tool such as a loading bucket) lies within the circumference of the front wheels, a miniloader is obtained with a large working range, whereby the miniloader is largely universally usable. The location of the second horizontal pivot axis line within the circumference of the front wheels, viewed in side view, means that this pivot axis line intersects the front wheels when the boom is oriented straight ahead, wherein the second pivot axis line is parallel to a rotational axis line of the front wheels or front axle. Firstly, the reachable working area is large thanks to use of the pivotable boom. A working area next to the miniloader can also be reached directly. Secondly, the weight loading is relatively high because the second pivot axis line falls within the wheel circumference in the retracted state. As a result, the tool—such as e.g. a loading bucket or pallet forks—is particularly close to the front axle, whereby a tipping moment on the front axle when carrying a load is small. In other words, the load can be relatively high compared with the own weight of the miniloader.

The phrase "the circumference of the front wheels" means, in the usual sense, the wheel circumference, also known as the "rolling circumference". It concerns the largest diameter of the tyre of the wheel. The term "pivot axis line" means a virtual line about which two parts can pivot relative to one another, and which in the usual fashion forms the centre line of a connection between said parts, such as an axle or stub axle which is mounted in a bearing, or a slewing ring with two slewing ring parts which are rotatable relative to one another about such a centre line.

In one embodiment, in the retracted state of the second arm part, the coupling piece is located at least partly between the front wheels. As a result, the distance between the front axle and the coupling piece is small, whereby the maximum weight loading is high.

In one embodiment, a greatest width dimension of the coupling piece is smaller than an intermediate distance between the front wheels. This makes it possible, in the retracted state, to position the coupling piece fully between the front wheels, or at least in a part of a pivot range of the coupling piece about the second pivot axis line, which further increases the maximum weight loading.

In one embodiment, the boom is designed such that in a side view of the miniloader and in the retracted state of the second arm part, an enclosed angle between a line between a rotational axis line of the front wheels and the first horizontal pivot axis line, and a line between the first horizontal pivot axis line and the second horizontal pivot axis line, is less than 10 degrees, preferably between 5 and 9 degrees. Such a small enclosed angle allows a compact structure of the boom, wherein the second pivot axis line may extend at a short distance in front of the front axle.

In one embodiment, an angle between a line between the boom pivot axis line and the first horizontal pivot axis line, and the vertical, is less than 30 degrees, preferably between 20 and 26 degrees. Because of the relatively steeply upwardly extending first arm part, the second arm part can extend relatively steeply downward, and thereby the second end thereof can sit close to the front axle in the retracted state. This too further increases the maximum weight loading.

In one embodiment, a front side of the boom pivot device is located in front of the rotational axis line of the front wheels, viewed in top view. This location of the boom pivot device relatively far towards the front of the miniloader allows a large working range, and also ensures-preferably in combination with said angles in said ranges-that the second pivot axis line is located particularly close to the front axle in the retracted state.

In one embodiment, the boom pivot device comprises a slewing ring, preferably a hollow slewing ring. This allows pipes, e.g. pneumatic and/or hydraulic lines for controlling the boom and the tool arranged on the coupling piece during operation of the miniloader, to be routed from the front chassis part to the boom.

It is favourable, in particular with use of said hollow slewing ring, if a horizontal distance between the boom pivot axis line and the rotational axis line of the front wheels, viewed in side view, lies in the range between 25 and 200 mm, preferably between 50 and 125 mm. This makes it largely possible, in an efficient fashion, to route said lines through without obstructing the pivoting of the boom about the boom pivot axis line.

In one embodiment, the second arm part is extendable, e.g. telescopic. This significantly increases the working area of the miniloader. For example, in combination with the possibility-provided by the boom pivot device-of pivoting the boom about a vertical axis, it is now possible to carry out activities very close to the miniloader. Thus the tilt load of the miniloader is also relatively high since, in a retracted state of the second arm part, the boom is relatively short.

In one embodiment, the boom has an arm actuator for pivoting the second arm part relative to the first arm part about the first horizontal pivot axis line.

In one embodiment, the boom has a coupling piece actuator for pivoting the coupling piece relative to the second arm part about the second horizontal pivot axis line.

The arm actuator and/or the coupling piece actuator are each preferably a hydraulic cylinder.

In one embodiment, a support point of the arm actuator on the first arm part lies higher than a highest point of the front wheels. On use of a said hydraulic cylinder, this may be the point where a cylinder part of the hydraulic cylinder is supported on the first pivot arm. Thus the boom can be arranged relatively far forward on the front chassis part, since because of the relatively high position of said support point, the boom may have sufficient free space below the support point to pivot along the front wheels.

In one embodiment, the miniloader furthermore comprises a cab for an operator of the miniloader on the rear chassis part.

In one embodiment, the rear axle or rear wheel axle is a swing axle. In one embodiment, the rear wheels are spring-mounted on the rear chassis part. In one embodiment, a movement angle of the coupling piece about the second pivot axis line is at least 180 degrees. This increases the usability of the miniloader.

In one embodiment, the miniloader comprises a protection system which is designed to detect a first pivot angle of the first arm part about the boom pivot axis line, and/or a second pivot angle of the second arm part relative to the first arm part, and to emit a signal on the basis of the detected first and/or second pivot angle. With such a protection system, it is possible to effectively prevent an undesired contact of the boom with another part of the miniloader such as the cab or a wheel.

It is here furthermore favourable if the protection system is designed to detect the first pivot angle and the second pivot angle, and is furthermore designed to detect a weight loading on the coupling piece, and to emit a signal if a predefined maximum weight loading, dependent on one of the first and second pivot angles, is exceeded. This may prevent not only a said undesired contact, but also an undesired tipping of the miniloader on exceeding of a predefined maximum weight load, which maximum weight load may be dependent on the first and/or second pivot angles.

Figure 2A:
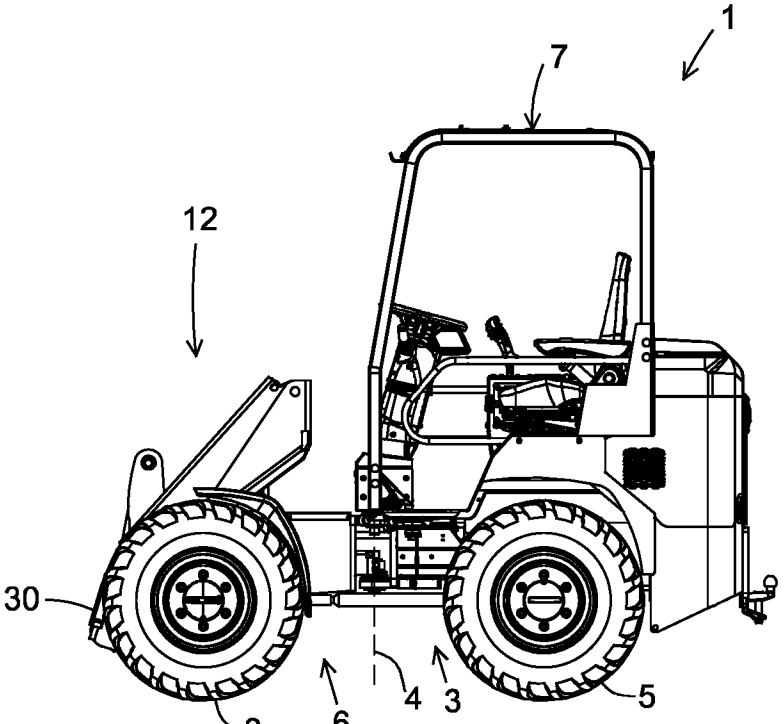
Figure 2B:
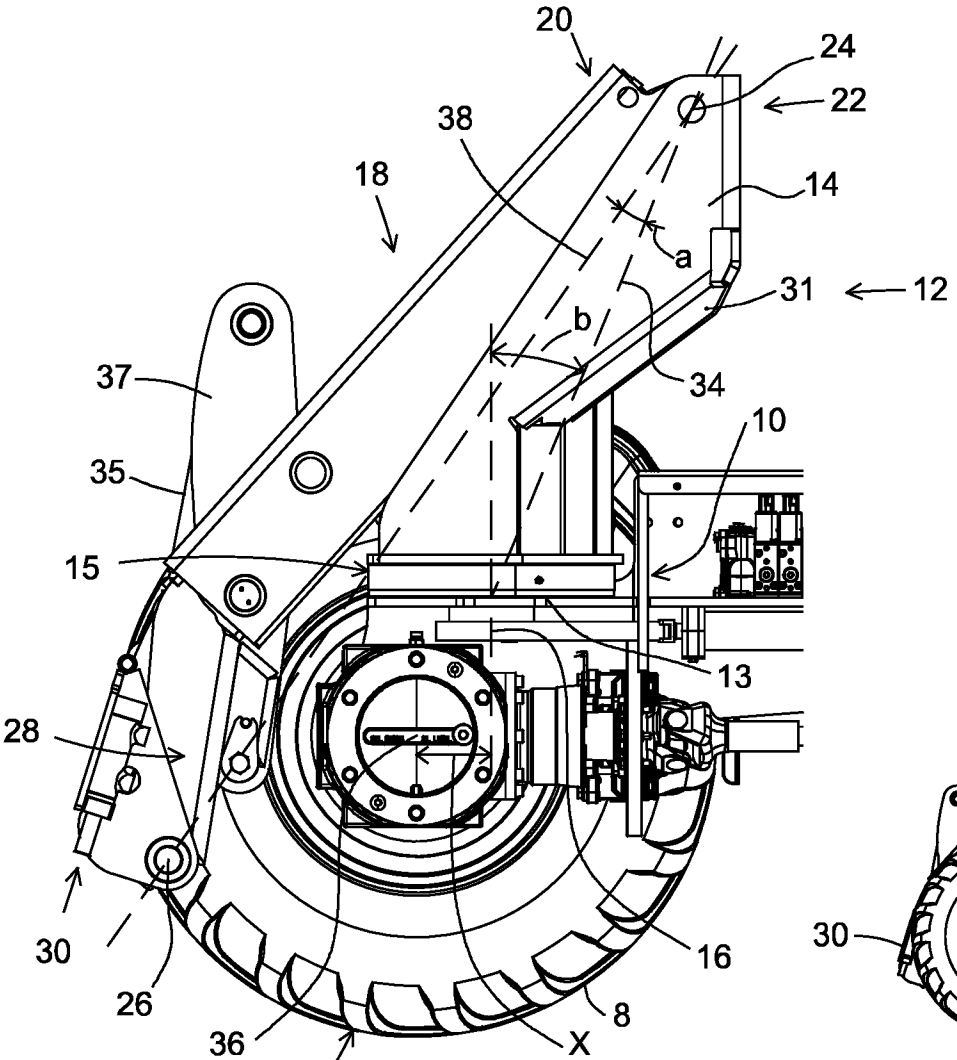
Figure 2C:
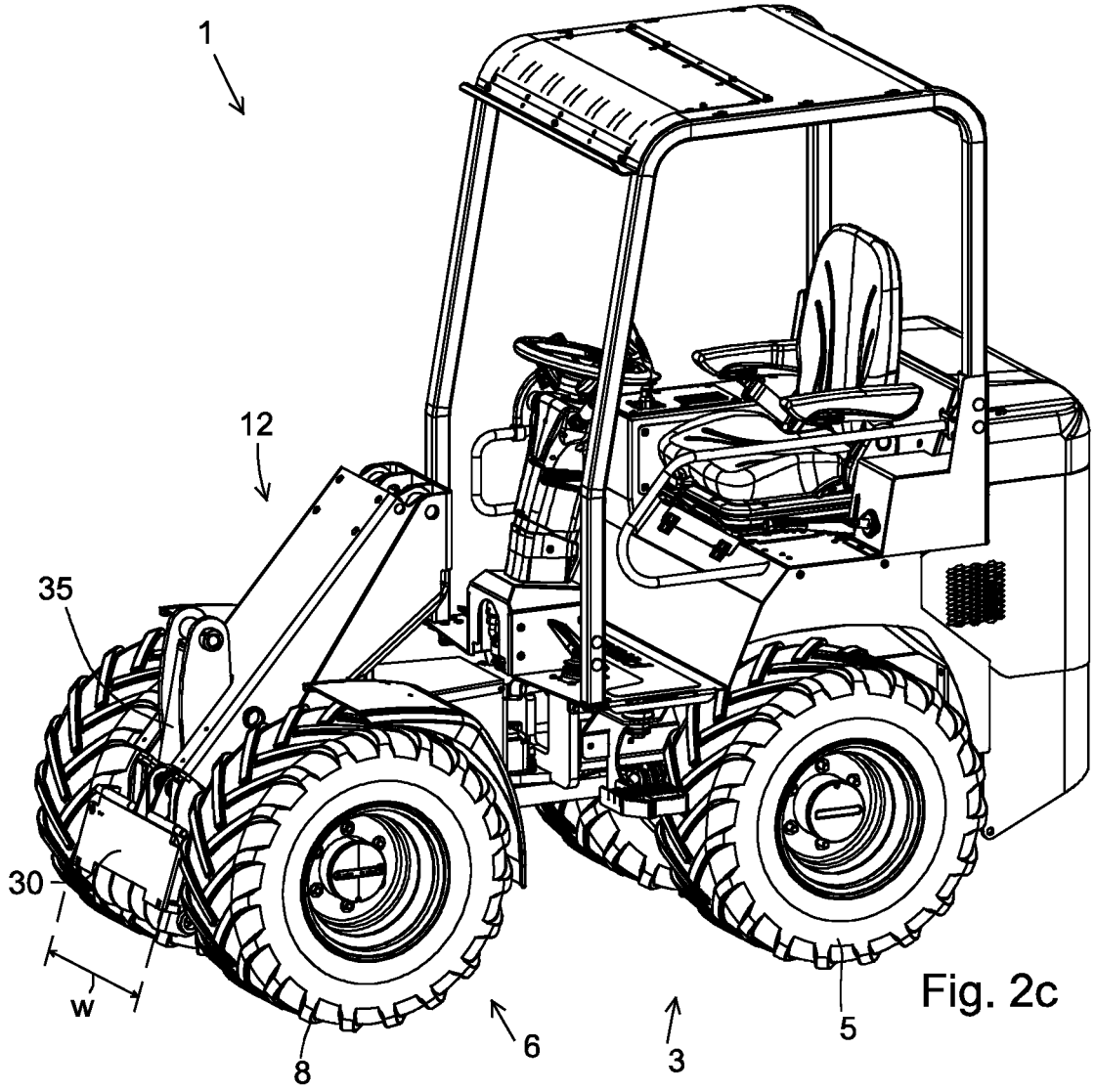

The present invention will be explained in more detail below with reference to the description of an embodiment of a miniloader according to the invention and with reference to the appended figures:

FIG. 1 shows a three-dimensional view of an exemplary embodiment of a miniloader according to the invention, provided with a loading bucket and with the boom in an extended state;

FIG. 2*a* shows in side view the miniloader from FIG. 1 without loading bucket and with the boom in a retracted state;

FIG. 2*b* shows in side view a front part of the miniloader from FIG. 2*a*, in which a front wheel has been omitted in order to show components situated between the front wheels;

FIG. 2*c* shows a three-dimensional view of the miniloader from FIG. 2*a;*

Figure 3A:
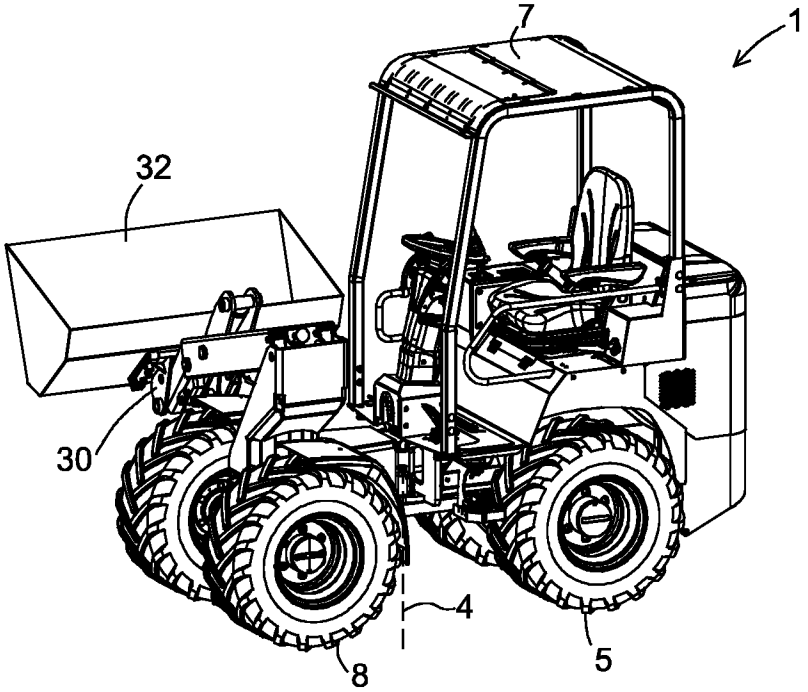
Figure 3B:
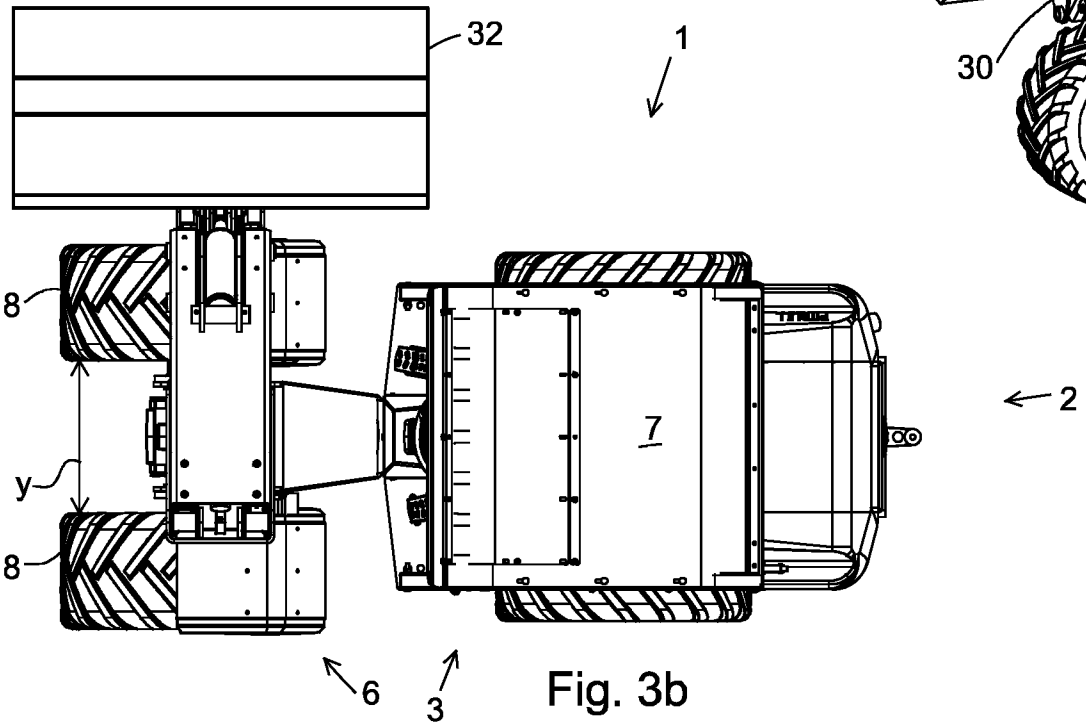
Figure 3C:
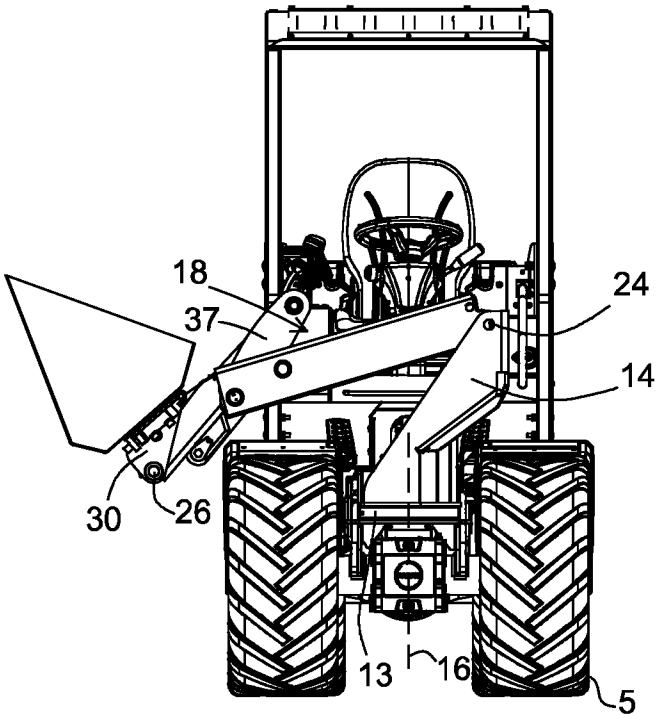

FIG. 3*a* shows a three-dimensional view of the miniloader from FIG. 1 with the boom in another state;

FIG. 3*b* shows the miniloader from FIG. 3*a* in top view;

FIG. 3*c* shows the miniloader from FIG. 3*a* in front view; and

Figure 4:
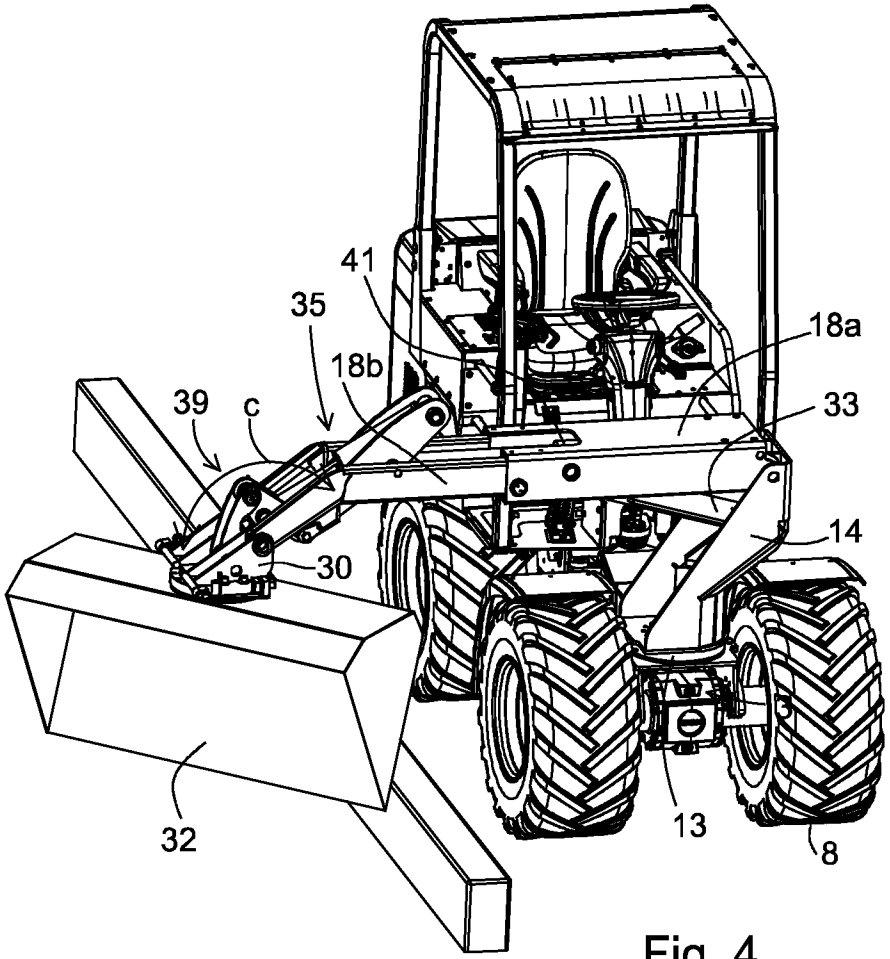

FIG. 4 shows a three-dimensional view of the miniloader from FIG. 1 with the boom in another state.

The figures show a miniloader 1. The miniloader has an articulated chassis 2. The articulated chassis 2 has a rear chassis part 3 on which rear wheels 5 are provided, and also has a front chassis part 6 which is pivotable relative to the rear chassis part about a vertical chassis pivot axis line 4 (see FIGS. 2*a* and 3*a*), and on which front wheels 8 are provided. The articulated chassis 2 also has a steering device 9 for steering the miniloader by means of pivoting the front chassis part and the rear chassis part relative to one another about the chassis pivot axis line. This may be achieved in a manner known to the person skilled in the art. The miniloader 1 furthermore has a cab 7 for an operator of the miniloader 1. The cab 7 is arranged on the rear chassis part 3. The rear axle 11 of the miniloader 1, i.e. the axle on which the rear wheels 5 are provided, is a swing axle. The rear wheels 5 are furthermore spring-mounted on the rear chassis part 3. The front wheels 8 and rear wheels 5 have tyres with a diameter of 800 mm.

The miniloader 1 has a boom pivot device 10 arranged on the front chassis part 6. The boom pivot device 10 comprises a hollow slewing ring 13. Supply lines for the boom, such as hydraulic lines, can be conducted through the hollow slewing ring 13 easily and efficiently. A horizontal distance x, indicated in FIG. 2*b*, between the boom pivot axis line 16 and the rotational axis line 36 of the front wheels, viewed in side view, is around 100 mm.

A pivotable boom 12 is mounted on the boom pivot device 10. The boom 12 comprises an upwardly extending first arm part 14, which more specifically extends upward at a small angle b from the vertical and is fixedly arranged on the boom pivot device 10, for pivoting the boom 12 relative to the chassis 2 about a vertical boom pivot axis line 16 during operation of the miniloader. Furthermore, the boom 12 has a second arm part 18 which is arranged with a first end 20 thereof on a free end 22 of the first arm part 14 and is pivotable relative to the first arm part 14 about a first horizontal pivot axis line 24, between a retracted state (shown in FIGS. 2*a* and 2*b*) in which the second arm part 18 extends downward, and an extended state (shown in FIG. 1) in which the second arm part 18 extends upward. The second arm part 18 is telescopic and for this comprises telescopic pieces 18*a* and 18*b*. The second arm piece 18*b* can be extended relative to the first arm piece 18*a*, as shown for example in FIGS. 1 and 4. In the example shown in the figures, the second arm piece 18*b* is extended and retracted by means of a hydraulic cylinder 41.

The boom 12 furthermore comprises a coupling piece 30. The coupling piece 30 is mounted pivotably about a second horizontal pivot axis line 26 on a second end 28, opposite the first end 20, of the second arm part 18. The coupling piece 30 is configured for coupling thereto a tool such as a loading bucket 32. In the retracted state of the second arm part 18, the second horizontal pivot axis line 26 lies within the circumference 27 of the front wheels 8, viewed in side view of the miniloader, as shown in FIG. 2*b*. In the retracted state of the second arm part 18, the coupling piece 30 is partly located between the front wheels 8. A maximum width dimension w (see FIG. 2*c*) of the coupling piece 30 is smaller than an intermediate distance y (see FIG. 3*b*) between the front wheels 8. Thus, as shown for example in FIG. 2*c*, the coupling piece 30 may be positioned between the front wheels in the retracted state. If a narrow loading bucket (FIG. 1 shows a relatively wide loading bucket) is arranged on the coupling piece, such a loading bucket may also be tipped partly between the front wheels.

The boom 12 has an arm actuator 33, configured as a hydraulic cylinder, for pivoting the second arm part 18 relative to the first arm part 14 about a first horizontal pivot axis line 24. A support point 31 of the hydraulic cylinder 33 on the first arm part 14 is located higher than a highest point of the front wheels 8. Furthermore, the boom 12 has a coupling piece actuator 35, also configured as a hydraulic cylinder, for pivoting the coupling piece 30 relative to the second arm part 18 about the second horizontal pivot axis line 26. A movement angle c (see FIG. 4) of the coupling piece 30 is at least 180 degrees. The actuator 35 rests on a support part 37 which is fixedly arranged on the second arm part 18, and is connected to the coupling piece 30 via a crank mechanism 39.

As FIG. 4 shows, the miniloader is usable particularly universally thanks to the large working range. The telescopic boom 12, pivotable relative to the chassis 2, can for example reach fully sideways over the front wheels 8, whereby a relatively wide loading bucket-such as the loading bucket 32 shown-can even perform a complete rotation about a vertical axis in the boom state shown in FIG. 4. This is possible with a rotation means, provided optionally on the coupling piece 30, for rotating the loading bucket 32 (or any other tool which is suitable for carrying out certain activities with the miniloader 1) relative to the coupling piece 30.

The boom 12 is designed such that, viewed in side view of the miniloader 1 and in the retracted state of the second arm part 18 (as shown in FIG. 2*b*), an enclosed angle a between a line 34 between a rotational axis line 36 of the front wheels and the first horizontal pivot axis line 24, and a line 38 between the first horizontal pivot axis 24 and the second horizontal pivot axis line 26, is less than 10 degrees. An angle b between a line 34 between the boom pivot axis line 16 and the first horizontal pivot axis line 24, and the vertical (shown in FIG. 2*b* by way of the vertical boom pivot axis line 16), is less than 30 degrees. A front side 15 of the boom pivot device 10 is located in front of the rotational axis line 36 of the front wheels, viewed in top view and as can be gathered from the side view in FIG. 2*b*.

Furthermore, the miniloader comprises a protection system which is designed to detect a first pivot angle of the first arm part about the boom pivot axis line 16, and a second pivot angle of the second arm part relative to the first arm part, and to emit a signal on the basis of the detected first and/or second pivot angles, such as for (threatened) contact between the tool and wheels, chassis or cab. The miniloader may be configured to block further movement of the boom on the basis of the signal. The protection system is furthermore designed to detect a weight loading on the coupling piece, and to emit a signal if a predefined maximum weight loading, dependent on one of the first and second pivot angles, is exceeded. The miniloader may be configured to block further movement of the boom and/or coupling piece on the basis of signal. Said detection of a weight loading may take place using a load cell and/or for example a pressure sensor in the coupling piece actuator.

The invention claimed is:

1. Miniloader (1), comprising:

an articulated chassis (2) comprising a rear chassis part (3) on which rear wheels (5) are provided, a front chassis part (6) which is pivotable relative to the rear chassis part about a vertical chassis pivot axis line (4), and on which front wheels (8) are provided, a steering device (9) for steering the miniloader by means of pivoting of the front chassis part and rear chassis part relative to one another about the chassis pivot axis line, and a boom pivot device (10) arranged on the front chassis part (6), the miniloader furthermore comprising:

a pivotable boom (12) mounted on the boom pivot device (10), the boom comprising:

an upwardly extending first arm part (14) which is fixedly arranged on the boom pivot device (10), for pivoting of the boom relative to the chassis about a vertical boom pivot axis line (16) during operation of the miniloader, a second arm part (18) which with a first end (20) is arranged on a free end (22) of the first arm part (14) and which is pivotable relative to the first arm part (14) about a first horizontal pivot axis line (24) between a retracted state, in which the second arm part (18) extends downward, and an extended state, in which the second arm part (18) extends upward, and a coupling piece (30) which is arranged on a second end (28) of the second arm part (18) located opposite the first end (20) and is pivotable about a second horizontal pivot axis line (26), for coupling thereto a tool, wherein in the retracted state of the second arm part (18), the second horizontal pivot axis line (26) lies within the circumference of the front wheels (8), viewed in a side view of the miniloader.

2. Miniloader according to claim 1, wherein in the retracted state of the second arm part (18), the coupling piece (30) is located at least partly between the front wheels (8).

3. Miniloader according to claim 1, wherein the greatest width dimension (w) of the coupling piece (30) is smaller than an intermediate distance (y) between the front wheels.

4. Miniloader according to claim 1, wherein the boom (12) is designed such that, in a side view of the miniloader and in the retracted state of the second arm part (18), an enclosed angle (a) between a line (34) between a rotational axis line (36) of the front wheels and the first horizontal pivot axis line (24), and a line (38) between the first horizontal pivot axis line (24) and the second horizontal pivot axis line (26), is less than 10 degrees.

5. Miniloader according to claim 1, wherein an angle (b) between a line (34) between the boom pivot axis line (16) and the first horizontal pivot axis line (24), and the vertical, is less than 30 degrees.

6. Miniloader according to claim 1, wherein a front side of the boom pivot device (10) is located in front of the rotational axis line (36) of the front wheels, viewed in top view.

7. Miniloader according to claim 1, wherein the boom pivot device (10) comprises a slewing ring.

8. Miniloader according to claim 1, wherein a horizontal distance (x) between the boom pivot axis line (16) and the rotational axis line (36) of the front wheels, viewed in side view, lies in the range between 25 and 200 mm.

9. Miniloader according to claim 1, wherein the second arm part (18) is telescopic.

10. Miniloader according to claim 1, wherein the boom (12) has an arm actuator (33) for pivoting the second arm part (18) relative to the first arm part (14) about the first horizontal pivot axis line (24).

11. Miniloader according to claim 10, wherein a support point of the actuator (33) on the first arm part (14) lies higher than a highest point of the front wheels (8).

12. Miniloader according to claim 1, wherein the boom has a coupling piece actuator (35) for pivoting the coupling piece (30) relative to the second arm part (18) about the second horizontal pivot axis line (26).

13. Miniloader according to claim 1, furthermore comprising a cab (7) for an operator of the miniloader on the rear chassis part (3).

14. Miniloader according to claim 1, wherein the rear axle (11) is a swing axle.

15. Miniloader according to claim 1, wherein the rear wheels (5) are spring-mounted on the rear chassis part.

16. Miniloader according to claim 1, wherein a movement angle (c) of the coupling piece (30) is at least 180 degrees.

17. Miniloader according to claim 1, comprising a protection system which is designed to detect a first pivot angle of the first arm part about the boom pivot axis line (16), and/or a second pivot angle of the second arm part relative to the first arm part, and to emit a signal on the basis of the detected first and/or second pivot angle.

18. Miniloader according to claim 17, wherein the protection system is designed to detect the first pivot angle and the second pivot angle, and is furthermore designed to detect a weight loading on the coupling piece, and to emit a signal if a predefined maximum weight loading, dependent on one of the first and second pivot angles, is exceeded.

* * * * *